US006393693B1

(12) United States Patent
Finocchi

(10) Patent No.: US 6,393,693 B1
(45) Date of Patent: May 28, 2002

(54) APPARATUS FOR THE MAINTENANCE OF THE NEEDLE-BEARING PLATES OF A NEEDLE-PUNCHING MACHINE

(75) Inventor: Paolo Lodovico Finocchi, Prato (IT)

(73) Assignee: Montenero O.M.T.P. Officina Meccanica di Finocchi Paolo & C.s.n.c., Prato (IT)

( * ) Notice: Subject to any disclaimer, the term of this patent is extended or adjusted under 35 U.S.C. 154(b) by 0 days.

(21) Appl. No.: 09/576,542

(22) Filed: May 23, 2000

(30) Foreign Application Priority Data

May 26, 1999 (IT) ..... FI99A0125

(51) Int. Cl.[7] ..... B23P 21/00

(52) U.S. Cl. ..... 29/709; 29/712; 29/791; 29/244; 29/402.08; 29/407.1; 29/426.5

(58) Field of Search ..... 29/402.01, 402.08, 29/407.01, 407.09, 407.1, 426.5, 703, 709, 712, 714, 244, 268, 283, 783, 790, 791

(56) References Cited

U.S. PATENT DOCUMENTS 5,636,425 A * 6/1997 Best ..... 29/407.04

5,953,804 A * 9/1999 Dragotta ..... 29/407.1

* cited by examiner

*Primary Examiner*—S. Thomas Hughes
*Assistant Examiner*—Jermie E. Cozart
(74) *Attorney, Agent, or Firm*—Browdy and Neimark

(57) ABSTRACT

An apparatus for the maintenance of a needle-bearing plate of a needle-punching machine equipped with an operating head movable in two perpendicular directions in a parallel relation to the plate mounted on the apparatus. The operating head includes a unit for extracting a damaged or worn needle, a unit for positioning a new needle in the respective seat of the plate, a data processing and storage unit for the operating control and for storing the needle map of each plate. The apparatus further has a unit for detecting the position of the needle seats cooperating with the data processing unit for carrying out the mapping of each plate. The apparatus also has a unit for detecting the presence of a needle in the respective position on the plate to indicate whether the needle is damaged or not.

11 Claims, 5 Drawing Sheets

APPARATUS FOR THE MAINTENANCE OF THE NEEDLE-BEARING PLATES OF A NEEDLE-PUNCHING MACHINE

DESCRIPTION

1. Field of the Invention

The present invention relates to an apparatus for the maintenance of the needle-bearing plates which the needle-punching machines are equipped of.

2. Description of the Prior Art

As is known, in a needle-punching machine a compacted fiber web is repeatedly passed through, while it advances, by a multiplicity of barbed needles carried by a support or plate reciprocating in a direction perpendicular to the advancing direction. The repeated passage of the needles through the fiber web results in a close interlacing among the fibers giving mechanical stability to the workpiece.

Non-woven fabric, some types of wall-to-wall carpets and other types of products even in fields other than the textile one are usually produced with this technique.

The needle-bearing plates are generally made of aluminium and sometimes of wood and are formed with a multiplicity of seats arranged in a prefixed order where respective needles, generally made of steel, are engaged. The needles have at least a tapered portion starting from the pointed end, while the opposite end, the so called "heel", is angle shaped and engage with a corresponding seat formed on a face of the plate.

The needle-bearing plates need a frequent maintenance for replacing both the bent or broken needles and those worn in correspondence of the end barbs which, due to the friction with the fibers, become rounded and therefore less effective.

Maintenance operation of the plates is presently carried out manually. Broken needles are found at sight, extracted and replaced. For the replacement of the worn needles a group replacement procedure is generally followed according to prefixed maintenance programs. In some cases, in which a group of needles is broken, broken needles are not replaced with new needles, but with used needles taken from random locations of the plate and these are replaced with new needles. In this way the risk of non-homogeneous works due to the presence of groups of needles with different degree of wear in different areas of the plate is avoided. Considering that the average size of the needle-bearing plates is 0.4×2 m and that they carry 10,000 random arranged needles (approx.), it appears how hard these operations may be.

SUMMARY OF THE INVENTION

The object of the present invention is to provide an apparatus by means of which the maintenance operations of the needle-bearing plates can be carried out in a fully automatic way, thus making easier the task of the operators, reducing the maintenance time and improving the quality of the service.

A particular object of the present invention is to provide an apparatus of the above mentioned type by means of which each broken needle can be detected and extracted and a new needle inserted in the clear seat.

A further object of the present invention is to provide an apparatus of the above mentioned type by means of which a map of the plate can be initially created with memorisation of the position of each needle.

These objects are reached with the apparatus for the maintenance of the needle-bearing plates of a needle-punching machine according to the invention, comprising a bed on which there is mounted a frame supporting the needle-bearing plate to be submitted to maintenance and an operating head mobile with respect to said bed in two perpendicular directions defining a plane parallel to the liying plane of the plate mounted on the support frame. The operating head comprises:

means for extracting a damaged or worn needle comprising a pressing member alignable to the needle as a consequence of the movement of the operating head, mobile toward the needle for engaging the end portion thereof in such a way to exert a pushing action by means of the tapered portion thereof, and plier means for grasping the needle at the heel portion thereof to exert a traction force thereon, the plier means being frontally aligned to the pressing member and located at the opposite part with respect to the plate;

means for positioning a new needle in the respective seat of the plate comprising a needle inserting plier for taking the needle out of a new needle feeding device integrally mobile with the operating head, alignable to the seat as a consequence of a movement of the operating head and mobile toward said seat to provide for the partial insertion of the needle therewithin, and a pushing member located substantially sideways of the needle inserting plier, alignable to the partially inserted needle as a consequence of a movement of the operating head to engage the heel end portion of the needle and exert a pushing action capable of completing the insertion.

The apparatus further comprises a process control unit comprising a memory where a map of the seats of the needles present on the needle-bearing plate is stored, on the basis of which the movements of the operating head are controlled.

In a preferred embodiment the operating head also comprises means for detecting if a needle of the plate is broken or bent, sequentially alignable to each needle of the plate as a consequence of a movement of the operating head and mobile toward and from the needle to which they come into aligment.

Furthermore, in particular the apparatus comprises means for detecting the position of the seats for the needles formed on the plate on the basis of the actual position of the operating head and with respect to a reference position thereof, said detecting means comprising a detecting signal emitter and a receiver of said signal axially aligned and integral to the operating head, arranged at opposite parts with respect to the plate, the receiver generating a response signal once the detecting signal coming from the emitter passes through one of said seats, the response signal being processed by said process control unit to produce a seat map of the needles on said plate which is stored in the memory.

Further characteristics, as well as the advantages, of the apparatus for the maintenance of the needle-bearing plates mounted on a needle-punching machine according to the present invention will be apparent from the following description of an embodiment thereof, made as a non-limiting example with reference to the attached drawings.

DESCRIPTION OF THE PREFERRED EMBODIMENT

Figure 1:
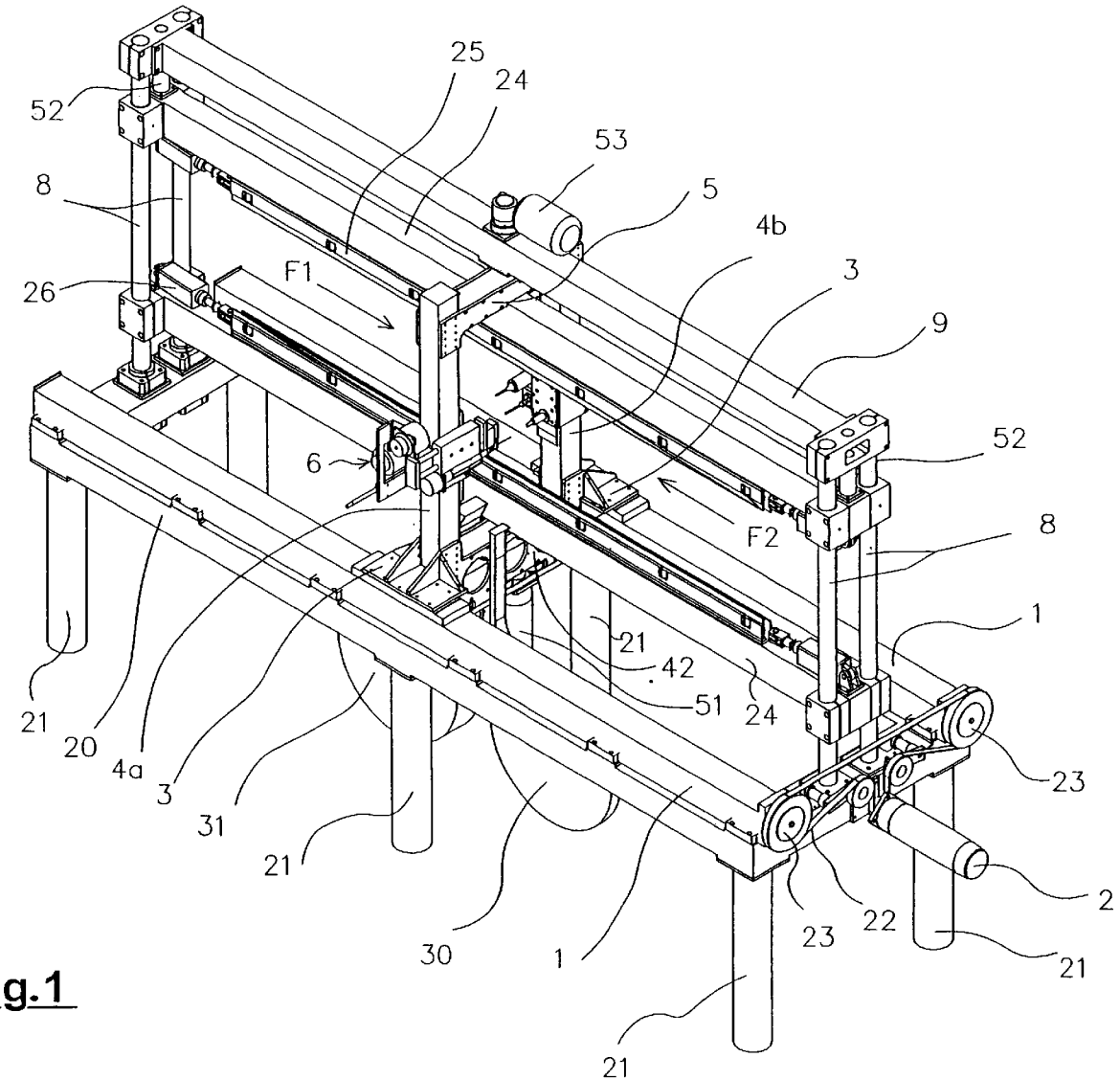
FIG. 1 is a perspective assembly view of the apparatus according to the invention.

With reference to FIG. 1, it has generally indicated at 20 a rectangular bed horizontally arranged on support uprights 21. A pair of ball screws schematically shown at 1, driven by a motor 2 through a belt 22 and pulley 23 transmission, are mounted along major sides of bed 20. Screws 1 drive into movement two respective sliders 3 connected to one another by a crossbar 42. Uprights 4*a*, 4*b* connected at their upper end by a bridge 5 extend upwardly from each of sliders 3. Each slider 3 houses a respective ball screw, driven by a motor 51, supported by crossbar 42, through a belt-and-pulley transmission, not shown, to move vertically a pair of sliders 7 carrying the operating head of the apparatus, generally shown at 6.

Two pairs of columns 8 connected to one another by a longitudinal bar 9 at their upper end extend upwardly from the minor sides of frame 20.

Two parallel bars 24 are slidably connected to the two pairs of column 8 and are placed below longitudinal bar 9, between uprights 4*a*, 4*b* for supporting blocking means 25, for example of the jaw type, for the positioning of the needle-bearing plate.

The vertical sliding of parallel bars 24 necessary to adjust their distance as a function of the height of the needle-bearing plate to be maintained is driven by means of screw actuators 52 driven by a geared motor 53 through a belt, while the opening and closing of blocking means 25 is driven through actuator devices 26 of any known type.

In the depicted embodiment the needle-bearing plate under maintenance is arranged on a vertical plane and the operating head 6 is mobile along two mutually perpendicular directions, which define a plane parallel to the plate held in position by blocking means 25.

Figure 2:
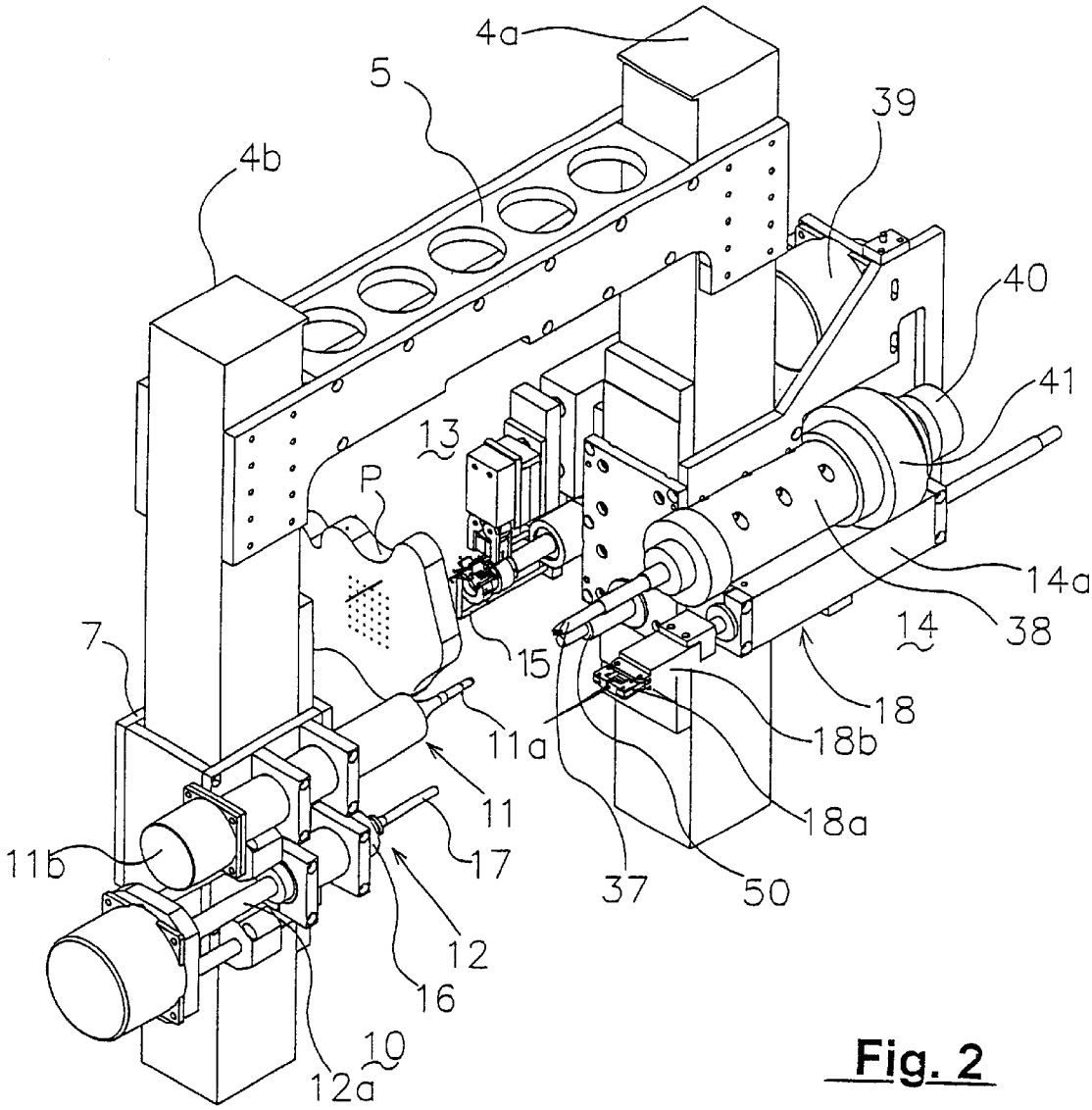
FIG. 2 is a perspective view of the operating head of the apparatus according to the invention taken in the direction of arrow F1 of FIG. 1.
Figure 3:
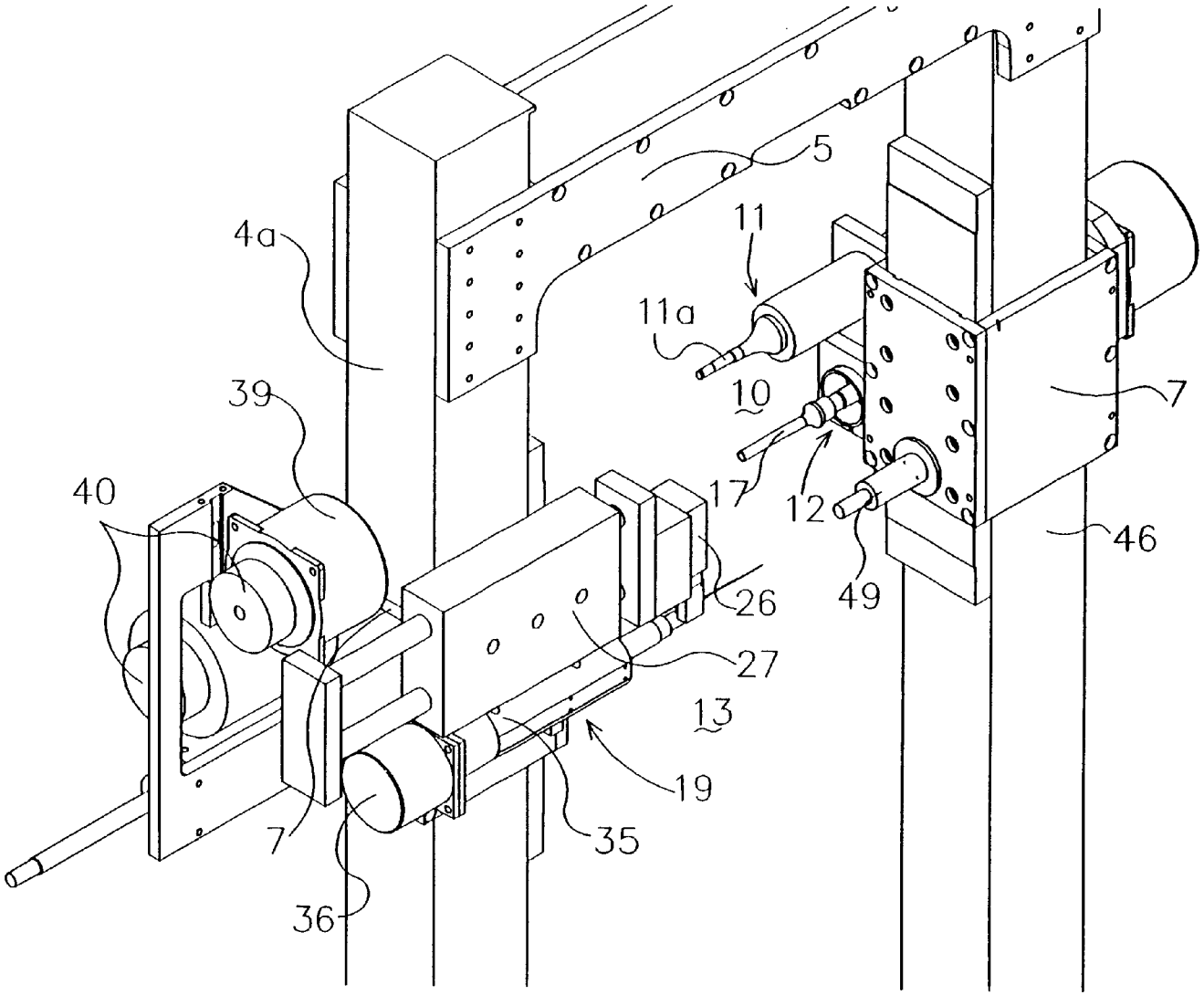
FIG. 3 is a perspective view of the operating head of the apparatus according to the invention taken in the direction of arrow F2 of FIG. 1.

As shown in FIG. 2 and FIG. 3 in greater detail, the operating head 6 comprises substantially three stations located at the same height along the sides of the two uprights 4*a*, 4*b*. More precisely, a first station 10 comprising a needle detecting device 11 and a needle ejecting device 12 (FIG. 2) is mounted on upright 4*b*. A second station 13 and a third station 14 are carried by upright 4*a* at opposite sides with respect to bridge 5, third station 14 facing first station 10 (FIGS. 2 and 3).

More particularly, second station 13 comprises a device 15 for inserting the needles into plate P, while station 14 comprises a plier device 18 for the extraction of the needle ejected by ejecting device 12 and a needle positioning device 37 for completing the insertion of the needle in the proper position in plate P, as will be described in greater detail hereinafter.

Needle detection device 11, shown in FIG. 2, essentially comprises a proximity sensor 11*a* axially moving to and from plate P mounted on bars 24 of the apparatus with the needles extending towards sensor 11*a*. Once sensor 11a is axially aligned to a needle, it approaches the needle end up to a prefixed distance sufficient to detect its presence. An actuator 11*b*, of the known type, integral to slider 7 is provided for the movement of sensor 11*a*.

Figure 7:
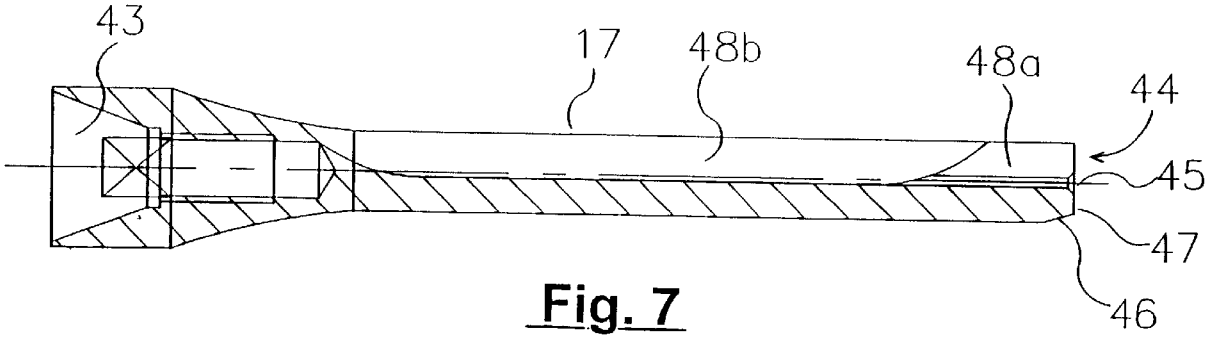
FIG. 7 is a longitudinal section of the pressing device taken along lines VII—VII of FIG. 6.
Figure 8:
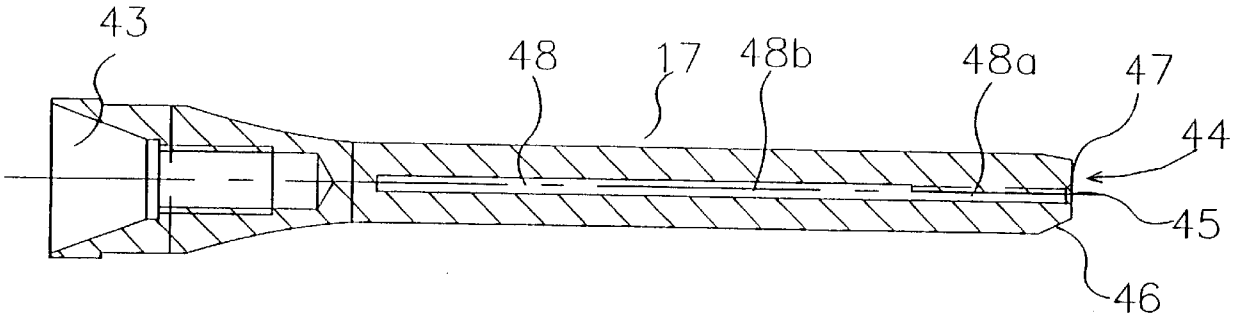
FIG. 8 is a longitudinal section of the pressing device taken along lines VIII—VIII of FIG. 7.
Figure 6:
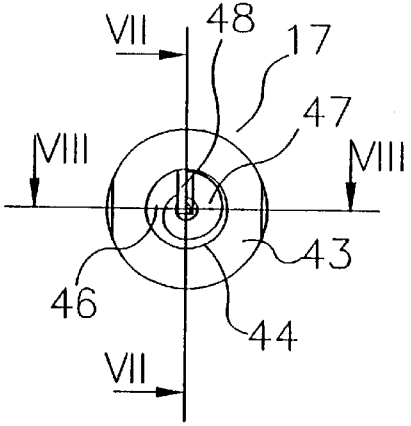
FIG. 6 is a front view of the pressing device for pushing out a worn needle.

Needle ejecting device 12 comprises a tubular casing 16, integral to slider 7 mobile along upright 4*b* and a pressing member 17 mounted in casing 16. Pressing member 17 is axially sliding within casing 16 in a reciprocating way by means of an actuator device 12*a* of the known type, to which it is connected through a spheric elastic joint, to compensate possible misalignments which may cause the system jam. Pressing member 17 is further provided with an axial rotary movement produced by a nut screw device, not shown and of the known type, applied to the stem of the actuator to which pressing member 17 is connected. Pressure member 17, shown in the position retracted in casing 16 in FIG. 2, is shown in greater detail in FIGS. 6, 7 and 8.

With reference to these figures, pressing member 17 is an elongate body comprising a conventional clutch 43 at one end, through which it is connected to the stem of its actuator, and a shaped end 44 by means of which it catches the end of the needle to be pushed off. To this purpose end 44 has a tapered central hole 45 and a conical perimetrical chamfer 46 of a width increasing from 0 to a value lower than the radius of said end 44. The surface portion 47 comprised between chamfer 46 and central hole 45 is slightly convex. A radial groove 48 longitudinally extend from end 44 up to near clutch 43 and has a restricted portion 48*a* near end 44 and an enlarged central portion 48*b*.

When pressing member 17 is moved to eject a broken or worn needle, needle engages with tapered hole 46 of pressing member 17 until allowed by the needle section i.e. until it becomes equal to the section of hole 45. At this point, due to the different size of needle and hole section, the axial movement of pressing member 17 generates a pushing action on the needle which is forced to slide with respect to plate P. If the needle to be ejected is bent, it is possible that its end is not aligned to hole 45. In this case the shaped surface 44 of pressing member 17 will anyway lead the needle toward the end of groove 48 within which it will engage as soon as, due to the rotation of pressing member 17, it comes into alignment to it.

It is advisable that the section of groove 48 be as equal as possible to that of the needle at least near end 44 so as to avoid that it may casually escape. However it is also helpful that, in case of needle break, the needle be allowed to release pressing member 17. To that end groove 48 has a restricted portion 48*a* and an enlarged portion 48*b*.

Figure 5:
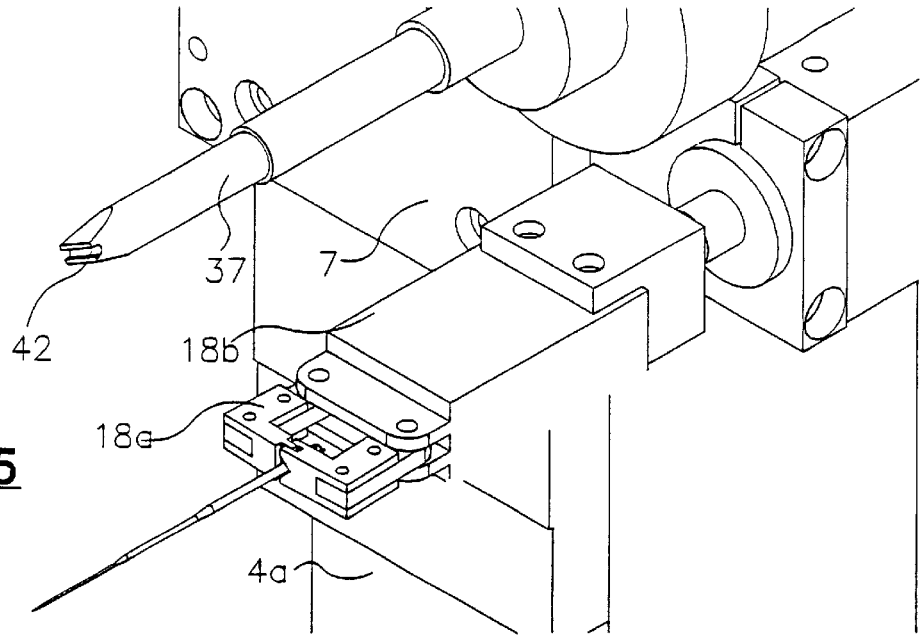
FIG. 5 is a detailed perspective view of the needle extraction device and the replaced needle positioning tool.

With reference to FIGS. 2 and 5, needle extraction device 18 is installed in third station 14 and is faced toward ejecting device 12 axially aligned with it. Needle extraction device 18 comprises a plier 18*a* axially aligned to pressing member 17 and provided with an axial reciprocating motion to move to the position of taking the needle heel, partially ejected by pressing member 17, and to move rearward to extract the needle. The opening and closure of plier 18*a*, as well as the axial movement, are driven in a conventional way by means of pneumatic actuators, generally shown at 18*b* and 14*a* respectively.

Figure 4:
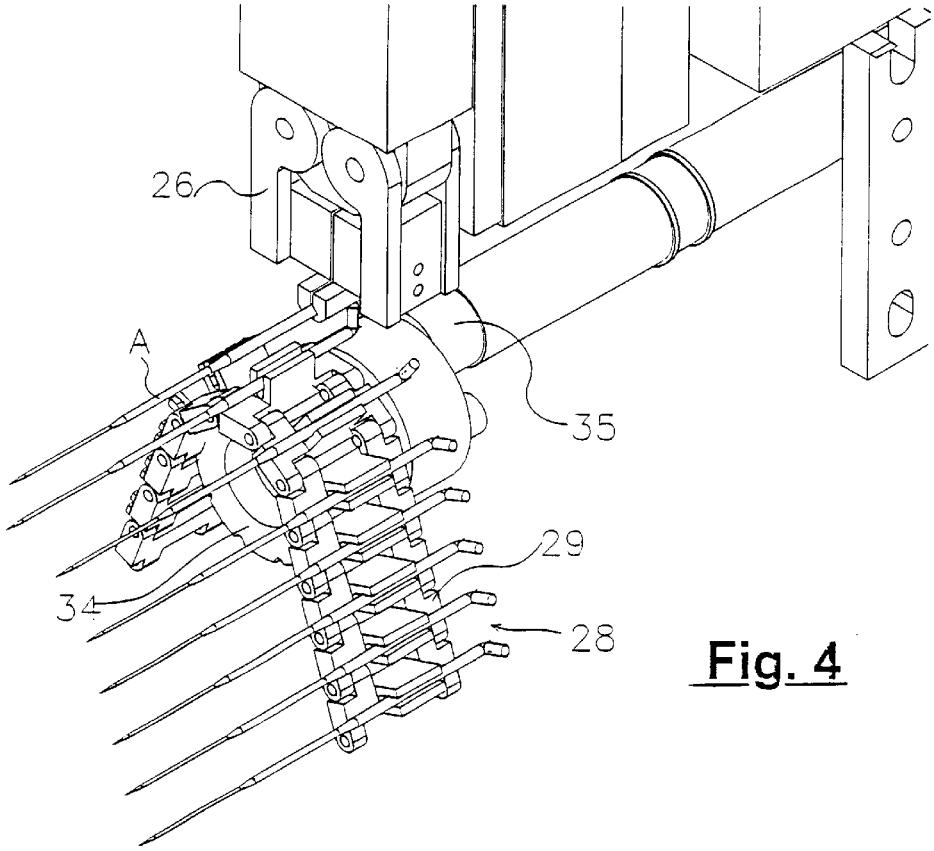
FIG. 4 is a detailed perspective view of the unit for feeding the needles to the insertion device.

Needle inserting device 19 shown in FIGS. 3 and 4, essentially comprises a vertical plier 26, integral to slider 7 sliding on upright 4*a*, and a piston actuator 27 for driving the displacement of the plier from a needle taking position to an insertion of the taken needle in the relevant seat on plate P and the return of the plier in the starting position. The needle inserting device co-operates with a device 28 for feeding needles A of the type in the form of a chain conveyor 29 unwinding from a first storage 30 placed below frame 20 and winding in a second storage 31 after being passed in correspondence to plier 26, integral to a shaft 35 rotated by a motor 36 mounted on slider 7. The presence of a needle in correspondence to plier 26 is detected by a sensor 32 (shown in FIG. 2) and a signal is emitted for activating the insertion cycle of a needle in the plate, comprising the steps of taking the needle by plier 26, advancing plier 26 toward plate P to insert of the needle in the seat and returning plier 26 in the starting position. A further sensor (not shown) downstream of needle detecting sensor 32 in taking position, signals the presence of an eventually not taken needle remaining on chain conveyor 29, thus allowing for the manual removal before it reaches second storage 31.

The needle positioning device, installed in the third station 14 above plier extraction device 18, comprises a stem-like tool 37 connected to a roto-translatory actuator 38 which can control either the only rotation of tool 37 or the simultaneous rotation and axial translation thereof. Roto-translatory actuator 38 is substantially of the conventional type and therefore is not shown in detail in the figures. It substantially comprises an endless screw, to which tool 37 is integral, rotated by a motor 39 by means of a belt (not shown) and pulley 40 transmission and connectable to a drive shaft through a friction clutch 41. When clutch 41 is engaged, both the screw and the nut screw integrally rotate and thus tool 37 rotates about its axis, while, when clutch 41 is disengaged, the screw slides along the nut screw which is fixed and tool 37 translates and rotates axially.

As shown in detail in FIG. 5, at the free end of the positioning tool 37 a groove 42 for engaging the needle heel is formed, as described hereinafter.

The apparatus is equipped with a microprocessor central control unit implemented with a suitable software through which the operating steps of the various devices and their synchronisation are managed.

The control unit is not described nor shown in detail, as being of conventional type for a person skilled in the art.

The operation of the apparatus according to the present invention is the following. First, a map of each needle-bearing plate, which the needle punching machine is equipped of, is achieved. Each needle is defined through the Cartesian coordinates of its own seat which are memorized, with a plate identification code, in the memory associated to the apparatus control unit. In order to map each plate, this is blocked between the jaws of the blocking means 25 and a scanning is carried out in an area capable of representing the mapping of the whole plate, through a laser emitter 49 positioned on slider 7 of upright 4*a* in a central position, i.e. between stations 13 and 14, associated to a respective receiver 50 mounted on slider 7 of upright 4*b* into alignment. The needles are previously removed from the scanning area in such a way that the laser emitter signal, passing through the relevant seats, defines the position thereof. Scanning automatically proceeds through progressive displacements on the whole area selected for the combined action of the longitudinal motion of sliders 3 and the vertical motion of sliders 7, according to the program.

Then, when a plate has to be subjected to maintenance, it is mounted on the apparatus and its reference code is communicated to the control unit in such a way that the latter can draw out of its memory the relevant map. At this point, proximity sensor 11 is successively brought into alignment to each needle of the plate, of which the coordinates are known, checking if it is broken, bent or anyway damaged, which can be deduced by the lack of needle presence signal, and on the basis of this acquirement the replacement actuators are activated. As an alternative, to the apparatus control unit there are provided reference data of the needles or group of needles which it has been planned to replace on the basis of programmed maintenance plans and then the step of extraction the worn needles is activated.

To that end, for each needle to be extracted the operating head 6 is moved in such a way to bring pressing member 17 and the needle to be extracted into axial alignment. The advancement of pressing member 17 causes the needle to slide into the plate and the heel thereof to progressively approach plier 18 which is an axially opposed position with respect to the plate. Then the needle heel is caught by plier 18, which moves rearward and completes the extraction thereof. The cycle is repeated for all the needles to be replaced by positioning operating head 6 each time in such a way to axially align pressing member 17 to a further needle.

Once the needle extraction is completed, the successive step of new needle insertion is started. To that end plier 26 draws out a needle from needle chain conveyor 29 and, after having brought it into alignment to its destination seat, advances toward rear face of the plate and inserts the needle in the seat.

The completion of the needle positioning in the plate is performed by tool 37 which sets the position of groove 42 formed on its free end so as to engage it with the half-inserted needle heel. Thanks to its roto-traslatory motion, tool 37 completely inserts the needle in the plate and sets the position of the heel according to the proper arrangement on the rear face of the plate.

The positioning error of operating head 6 is less than 0.1 mm, quite compatible with the precision necessary for the positioning of their actuating devices, considering that the distance between the needle varies between 6 and 20 mm and the diameter of each needle is equal to 1.83 mm.

Variations and/or modifications can be brought to the apparatus for the maintenance of the needle bearing plates of a needle punching machine according to the present invention, without departing from the scope of the invention as set forth in the attached claims.

What is claimed is:

1. Apparatus for the maintenance of a needle-bearing plate of a needle punching machine and for replacing needles in said plate, said plate having a plurality of through seats arranged in a prefixed order, the needles having respective angled ends and each needle having a tapered portion, said angled ends being engaged within said seats, the apparatus comprising:

a bed, a frame mounted on said bed for supporting the needle-bearing plate to be submitted to maintenance, said frame supporting said plate so that said plate lies in a plane, an operating head mobile with respect to said bed in two mutually perpendicular directions defining a plane parallel to the plane in which the plate is supported on the supporting frame, said operating head comprising:

means for extracting a damaged or worn one of the needles, comprising a pressing member alignable to the damaged or worn needle as a consequence of a movement of the operating head and mobile toward the damaged or worn needle to engage the angled end of the damaged or worn needle so as to exert a push through the tapered portion of the needle, and a plier device for grasping damaged or worn needle in correspondence to the angled end of the damaged or worn needle to exert a traction force thereon, said plier device being frontally aligned to said pressing member and being positioned so that said plate is located between said plier device and said pressing member; and means for positioning a new needle in a respective through seat of said plate comprising a needle inserting plier for taking a needle from a new needle feeding device integrally movable with said operating head, said inserting plier being alignable to said respective through seat as a consequence of a movement of the operating head and movable toward said respective through seat to partially insert the new needle there into, and a pushing member placed substantially sideways of said inserting plier, alignable to said partially inserted new needle, as a consequence of a movement of said operating head, to engage the angled end thereof and exert a pushing force for completing the insertion; and said apparatus further comprising processor means for controlling operation of said operating head, said processor means including a memory unit for storing a map of the through seats present on said plate.

2. Apparatus according to claim 1, wherein said operating head is slidably mounted on support means placed sideways of said frame for supporting said needle-bearing plate, said support means being slidably mounted on said bed for sliding movement in two directions that are perpendicular to each other.

3. Apparatus according to claim 2, wherein said support means comprises a pair of uprights and said support frame of the needle-bearing plate is placed therebetween, said operating head being vertically slidable along said uprights, which in turn are mounted on sliders movable along two opposite sides of said bed.

4. Apparatus according to claim 1, wherein said frame for supporting the needle-bearing plate comprises means for blocking said plate.

5. Apparatus according to claim 1, further comprising means for detecting if a needle of the plate is broken or bent sequentially alignable to each needle of the plate as a consequence of a movement of said operating head and mobile to and from a needle that comes into alignment with said means for detecting, wherein said means for detecting are axially displaceable over a prefixed distance.

6. Apparatus according to claim 1, wherein said pressing member has a longitudinal groove extending from its free end, with which the end portion of the damaged or warn needle engages, said pressing member being axially rotatable to align said longitudinal groove to said damaged or worn needle even when the damaged or worn neeedle end is not aligned axially to said pressing member.

7. Apparatus according to claim 6, wherein said pressing member is formed with a tapered seat for said longitudinal groove at its free end.

8. Apparatus according to claim 7, wherein said free end of said pressing member is chamfered.

9. Apparatus according to claim 1, wherein said new needle feeding device comprises a chain conveyor, on which new needles are arranged parallel to each other, sliding below said inserting plier between a feeding storage and a collecting storage placed below said bed.

10. Apparatus according to claim 1, wherein said pressing member has a diametral groove at its free end for engaging said needle angled end, and is axially rotatable to position said angled end in a prefixed angular position with respect to said plate.

11. Apparatus according to claim 1, further comprising means for detecting the position of said seats on the basis of the current position of said operating head and with respect to a reference position thereof, said detecting means comprising a detection signal emitter and a receiver of said detection signal axially aligned and integral to said operating head, arranged at opposite sides with respect to said plate, the receiver of the detection signal generating a response signal once the detection signal coming from said emitter passes through one of said seats, said response signal being fed to said processor means and processed to create a map of the seats of said plate, which is memorized in said memory units.

* * * * *